US010118676B2

(12) United States Patent
Lin et al.

(10) Patent No.: US 10,118,676 B2
(45) Date of Patent: Nov. 6, 2018

(54) SUBMARINE SURVEY PLATFORM AND METHOD FOR USING THE SAME

(71) Applicant: DALIAN UNIVERSITY OF TECHNOLOGY, Dalian (CN)

(72) Inventors: Yan Lin, Dalian (CN); Yanyun Yu, Dalian (CN); Xiaoning Jiang, Dalian (CN); Guan Guan, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 0 days.

(21) Appl. No.: 15/942,409

(22) Filed: Mar. 30, 2018

(65) Prior Publication Data

US 2018/0222557 A1 Aug. 9, 2018

Related U.S. Application Data

(63) Continuation-in-part of application No. PCT/CN2016/094046, filed on Aug. 9, 2016.

(30) Foreign Application Priority Data

Jan. 31, 2016 (CN) ..... 2016 1 0063818

(51) Int. Cl.
*B63B 35/44* (2006.01)
*B63B 9/00* (2006.01)

(52) U.S. Cl.
CPC ..... *B63B 35/44* (2013.01); *B63B 9/00* (2013.01); *B63B 2211/02* (2013.01); *B63B 2708/00* (2013.01)

(58) Field of Classification Search
CPC ..... B63B 9/00; B63B 35/44
See application file for complete search history.

(56) References Cited

U.S. PATENT DOCUMENTS 3,541,588 A * 11/1970 Ragland ..... B63B 35/44 114/244
3,621,662 A * 11/1971 Starr et al. ..... B63B 35/44 114/257

(Continued)

FOREIGN PATENT DOCUMENTS

CN 104058072 * 9/2014

*Primary Examiner* — Stephen P Avila
(74) *Attorney, Agent, or Firm* — Matthias Scholl, PC; Matthias Scholl

(57) ABSTRACT

A submarine survey platform, including: a gasbag; a gas tube; a floater; an upper longitudinal plate; a lower longitudinal plate; diaphragm plates including upper openings, lower openings, and trapezoid openings disposed between the upper openings and the lower openings; and diagonal braces. The upper longitudinal plate includes a flat plate and a flanged plate. The lower longitudinal plate is a rectangular plate. The upper longitudinal plate pass through the upper openings, and the lower longitudinal plate pass through the lower openings. The diagonal braces and longitudinal stiffeners are disposed between every two adjacent diaphragm plates. Two diaphragm plates at two ends of the flat plate are provided with a lifting lug. The diagonal braces are symmetrically disposed and include outward braces and inward braces which are crossed with each other. Cross points of the upper/lower longitudinal plate with the diaphragm plates are support points of the upper/lower longitudinal plate.

2 Claims, 10 Drawing Sheets

(56) References Cited

U.S. PATENT DOCUMENTS

| | | | | | |
|---|---|---|---|---|---|
| 4,175,269 | A * | 11/1979 | Rebikoff | H04N 7/185 | 348/81 |
| 4,481,899 | A * | 11/1984 | Einstabland | B63B 35/50 | 114/258 |
| 4,904,118 | A * | 2/1990 | Thiemann, III | B63B 35/44 | 405/195.1 |
| 8,251,002 | B2 * | 8/2012 | Wang | B63B 35/44 | 114/125 |
| 2011/0150623 | A1 * | 6/2011 | Thomas | B63B 35/44 | 414/803 |
| 2017/0218919 | A1 * | 8/2017 | Wong | F03D 7/0204 | |

* cited by examiner

SUBMARINE SURVEY PLATFORM AND METHOD FOR USING THE SAME

CROSS-REFERENCE TO RELATED APPLICATIONS

This application is a continuation-in-part of International Patent Application No. PCT/CN2016/094046 with an international filing date of Aug. 9, 2016, designating the United States, now pending, and further claims foreign priority benefits to Chinese Patent Application No. 201610063818.7 filed Jan. 31, 2016. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

Field of the Invention

The invention relates to the field of marine survey and marine engineering equipment, and more particularly to a submarine survey platform and method for using the same.

Description of the Related Art

Typical marine survey platforms are of a floating type and are subject to the wind and waves. In recent years, several submarine survey platforms have been developed. However, conventional submarine survey platforms are bulky, costly, complex, and relatively expensive to maintain.

SUMMARY OF THE INVENTION

In view of the above-described problems, it is one objective of the invention to provide a submarine survey platform that is safe, reliable, efficient, and easy to operate and maintain.

It is another objective of the invention to provide a method for using the same.

To achieve the above objective, in accordance with one embodiment of the invention, there is provided a submarine survey platform, comprising: a gasbag; a gas tube; a floater; an upper longitudinal plate; a lower longitudinal plate; diaphragm plates, the diaphragm plates comprising upper openings, lower openings, and trapezoid openings disposed between the upper openings and the lower openings; and diagonal braces. The upper longitudinal plate comprises a flat plate adapting to support measuring instrument, and a flanged plate; the lower longitudinal plate is a rectangular plate; the upper longitudinal plate pass through the upper openings, and the lower longitudinal plate pass through the lower openings; the diagonal braces and longitudinal stiffeners are disposed between every two adjacent diaphragm plates; two diaphragm plates respectively disposed at two ends of the flat plate are provided with a lifting lug; the diagonal braces are symmetrically disposed, and comprise outward braces and inward braces which are crossed with each other; cross points of the upper/lower longitudinal plate with the diaphragm plates are support points of the upper/lower longitudinal plate; the gasbag is disposed in and passes through each of the trapezoid openings; one end of the gasbag is connected to the gas tube; another end of the gas tube is provided with an air valve, and the air valve is attached to the floater.

The diaphragm plates are a trapezoidal frame, four edges of the diaphragm plates comprise first flanged plates, and the trapezoid openings are surrounded by second flanged plates.

The diagonal braces employ trough type members, cross points of the outward braces and the inward braces are reinforced using bolt and nuts.

The longitudinal stiffeners are symmetrically disposed at a bottom of the lower longitudinal plate, and are a right-angle structure connected to the lower longitudinal plate and the diaphragm plates.

In another aspect, the disclosure also provides a method for using the submarine survey platform, the method comprising:

(a) descending the submarine survey platform, which comprises:

providing a floating transport platform equipped with a winch and a cable;

installing the measuring instrument on the flat plate;

inflating the gasbag via the gas tube;

charging the floating transport platform with water to descend the floating transport platform to support the submarine survey platform;

allowing the flat plate to float on water surface, and employing an assistant tug to drag the submarine survey platform away from a deck of the floating transport platform;

allowing the floating transport platform to float upward, connecting the winch and the lifting lug of the submarine survey platform using the cable;

opening the air valve, allowing the submarine survey platform to descend and tension the cable;

controlling, by the winch, the submarine survey platform to sink and sit on seabed; and loosening the cable, closing the air valve, and attaching the gas tube to the floater;

(b) withdrawing the submarine survey platform, which comprises:

picking up the gas tube attached to the floater;

inflating the gasbag, and shutting down the air valve;

allowing the submarine survey platform to float on the water surface, descending the floating transport platform, employing the assistant tug to drag the submarine survey platform to the deck of the floating transport platform, and allowing the floating transport platform to floating upward, achieving the recovery of the submarine survey platform.

Advantages of the submarine survey platform and method for using the same according to embodiments of the invention are summarized as follows. The submarine survey platform comprises a gasbag; a gas tube; an air valve; a floater; an upper longitudinal plate; a lower longitudinal plate; diaphragm plates; and diagonal braces. The upper longitudinal plate comprises a flat plate adapting to support measuring instrument, and a flanged plate; the lower longitudinal plate is a rectangular plate; the upper longitudinal plate pass through the upper openings, and the lower longitudinal plate pass through the lower openings; the diagonal braces and longitudinal stiffeners are disposed between every two adjacent diaphragm plates; two diaphragm plates respectively disposed at two ends of the flat plate are provided with a lifting lug; the diagonal braces are symmetrically disposed, and comprise outward braces and inward braces which are crossed with each other; cross points of the upper/lower longitudinal plate with the diaphragm plates are support points of the upper/lower longitudinal plate; the gasbag is disposed in and passes through each of the trapezoid openings; one end of the gasbag is connected to the gas tube; another end of the gas tube is provided with an air valve, and the air valve is attached to the floater. The submarine survey platform takes full account of the practical application requirements, as well as the comprehensive balance between technology and economy efficiency. The submarine survey platform is made of glass fiber reinforced plastics (FRP), which is light, inexpensive, and easy to manufacture.

2. The longitudinal plates are an integrated structure, contain little connection joints, and are easy to construct, which not only reduces the construction cost, but also improves the overall strength and safety of the survey platform.

3. The design of the submarine survey platform takes full account of the lifting operation requirements, uses the inflated air bag to float up the platform, and provides the floating platform to assist the sink operation, ensuring the controllability and safety of the sinking process.

4. The submarine survey platform is novel, easy to manufacture and operate, exhibits good magnetic resistance and strong anti-corrosion ability. It is a reliable, efficient and economical platform for measuring the ocean bottom.

BRIEF DESCRIPTION OF THE DRAWINGS S

Figure 9:
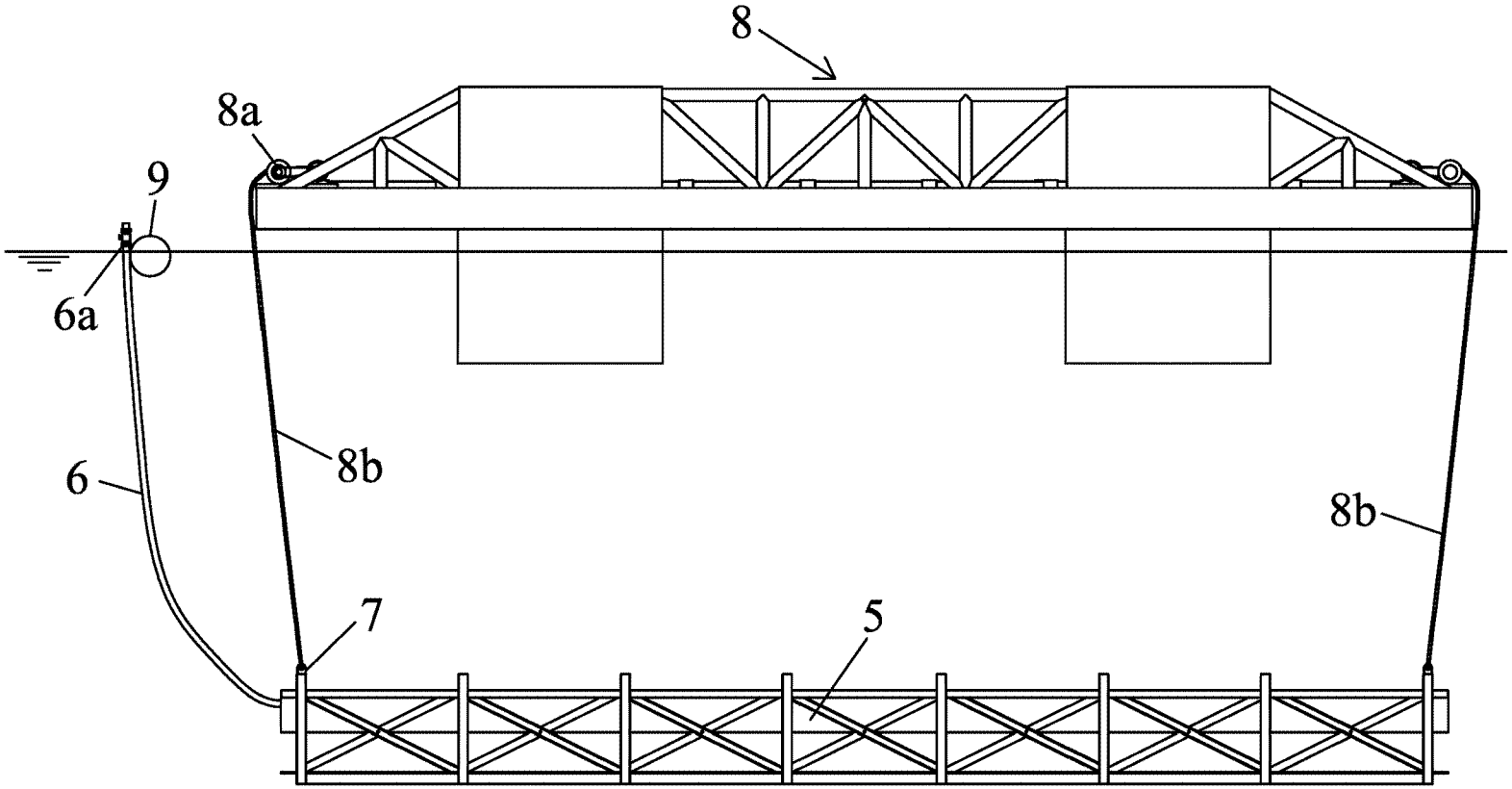
Figure 10:
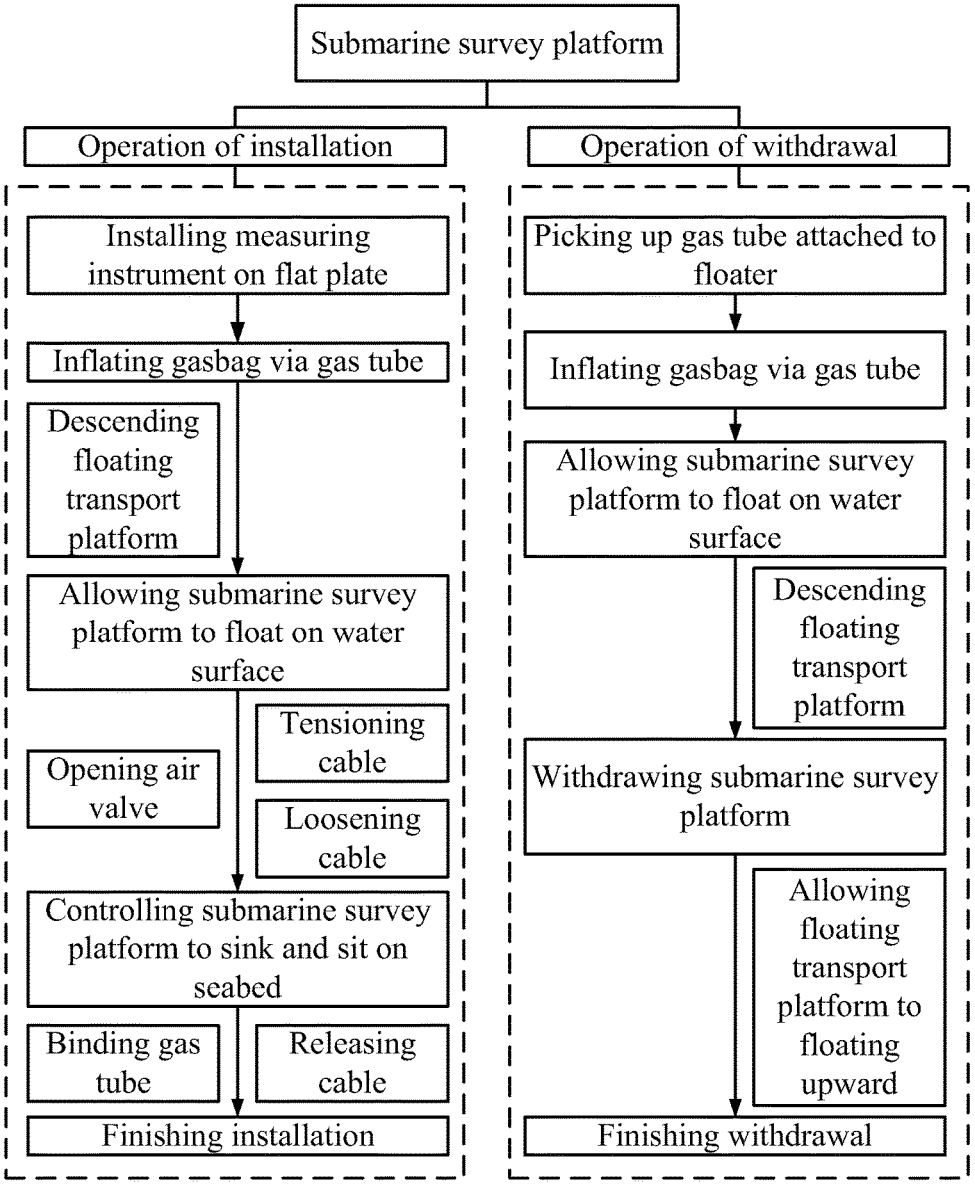

FIG. 9 a front view showing layout of a submarine survey platform according to one embodiment of the disclosure; and FIG. 10 a flow chart for laying a submarine survey platform according to one embodiment of the disclosure.

In the drawings, the following reference numbers are used: 1. Upper longitudinal plate; 1*a*. Flat plate; 1*b*. Flanged plate; 2. Lower longitudinal plate; 2*a*. Longitudinal stiffener; 3. Diaphragm plate; 3*a*. First flanged plate; 3*b*. Trapezoid opening; 3*c*. Second flanged plate; 3*d*. Upper openings, 3*e*. Lower opening; 4. Diagonal brace; 4*a*. Outward brace; 4*b*. Inward brace; 4*c*. Bolt; 4*d*. Nut; 5. Gasbag; 6. Gas tube; 6*a*. Air valve; 7. Lifting lug; 8. Floating transport platform; 8*a*. Winch; 8*b*. Cable; 9. Floater.

DETAILED DESCRIPTION OF THE EMBODIMENTS

For further illustrating the invention, experiments detailing a submarine survey platform and method for using the same are described below. It should be noted that the following examples are intended to describe and not to limit the invention.

Figure 1:
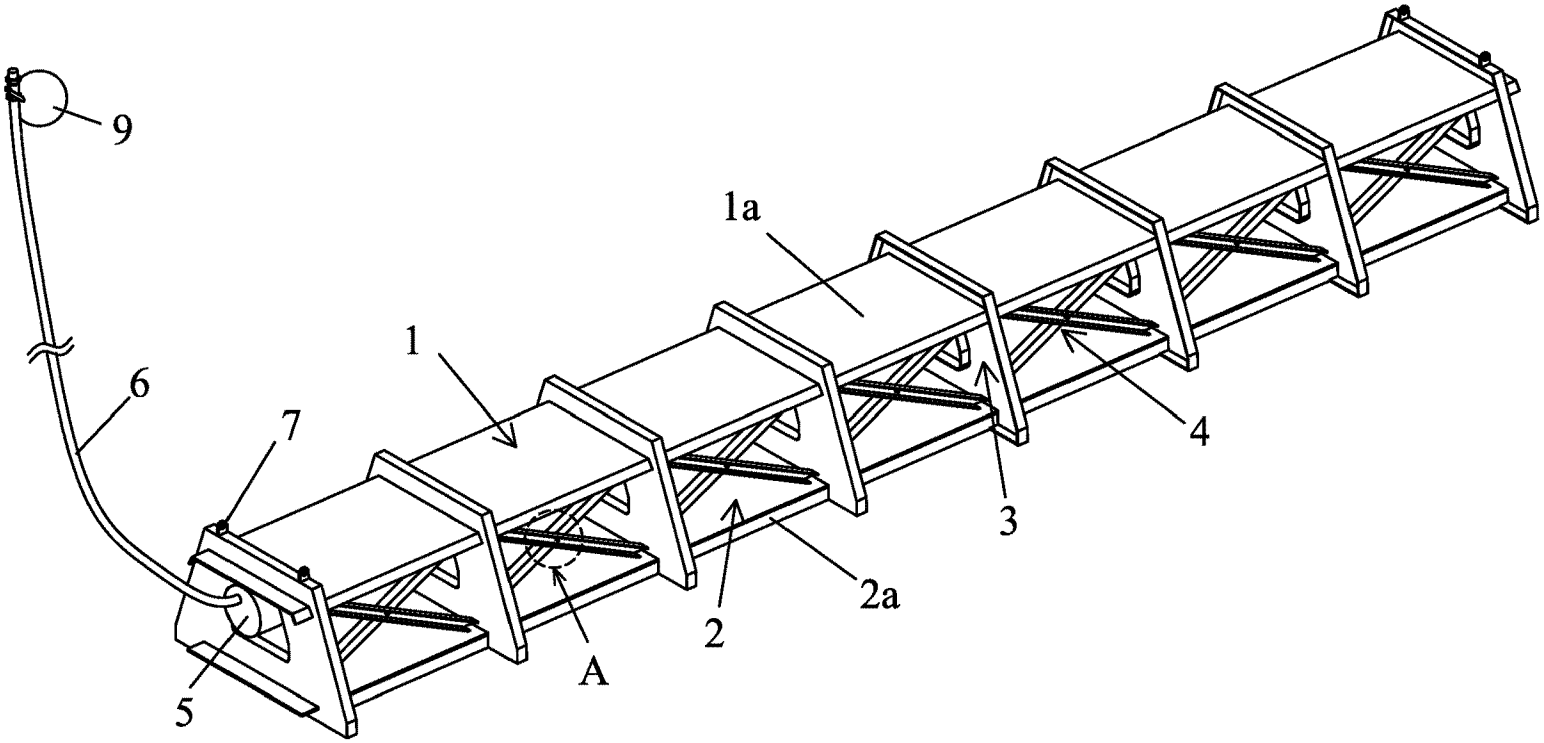
FIG. 1 is a schematic diagram of a submarine survey platform according to one embodiment of the disclosure.
Figure 2:
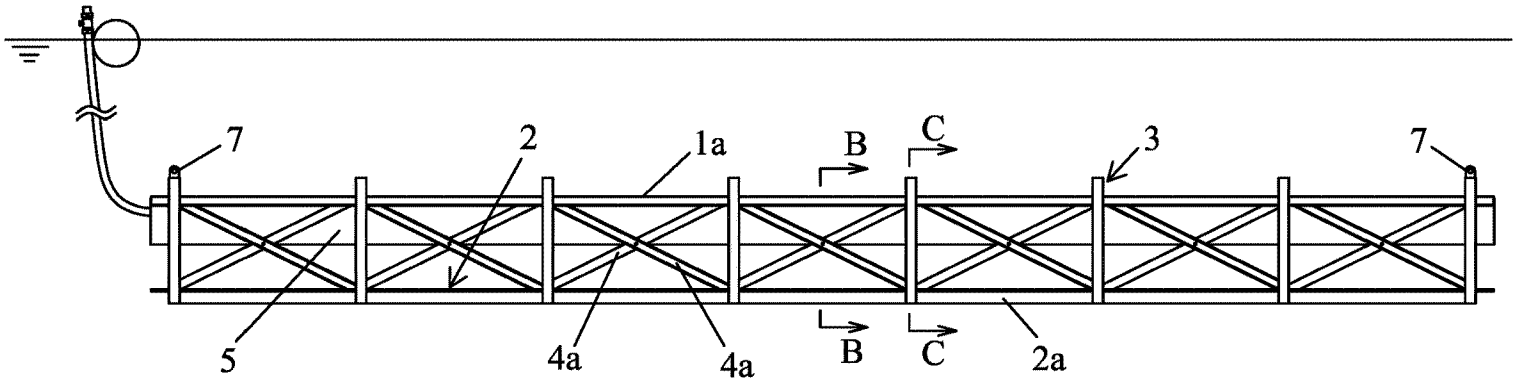
FIG. 2 is a front view of a submarine survey platform according to one embodiment of the disclosure.
Figure 3:
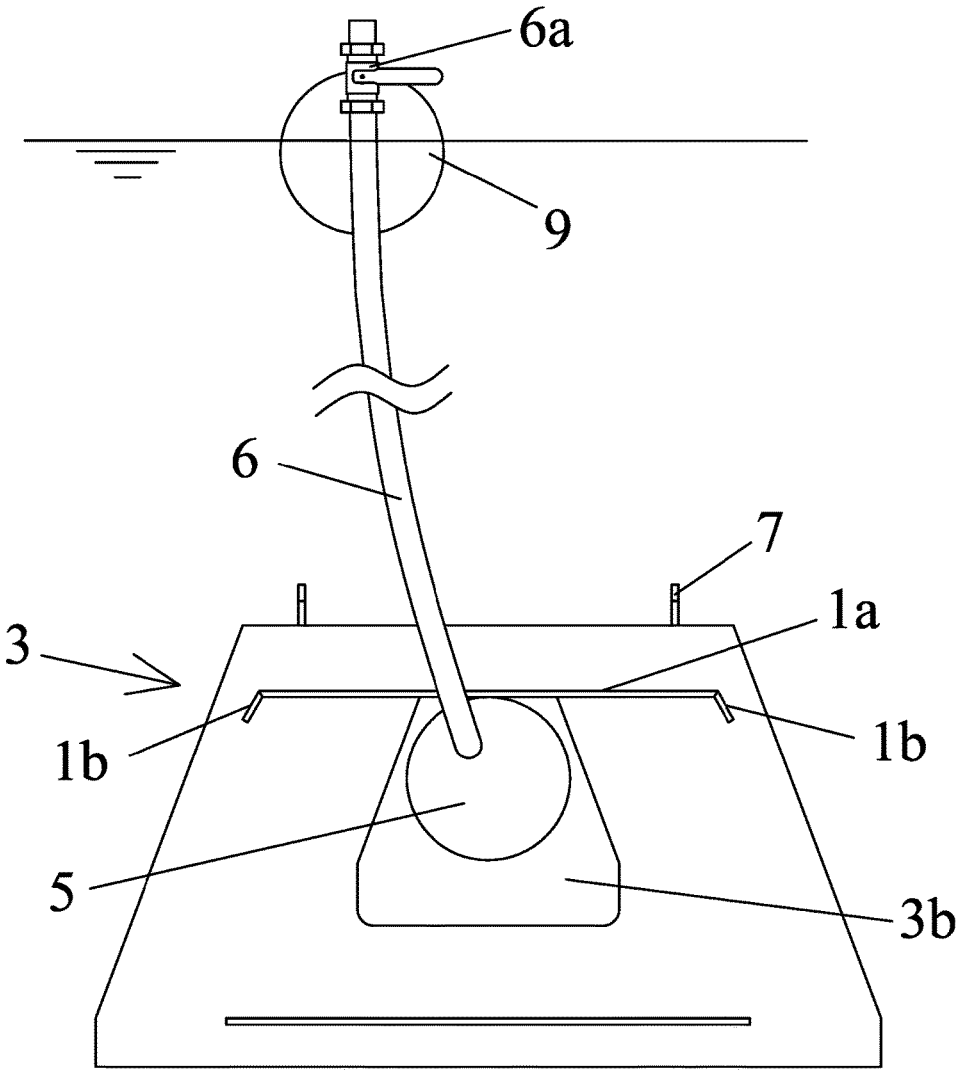
FIG. 3 is a side view of a submarine survey platform according to one embodiment of the disclosure.

As shown in FIGS. 1-3, a submarine survey platform made of nonmetal materials is provided. The submarine survey platform comprises an upper longitudinal plate 1; a lower longitudinal plate 2; diaphragm plates 3; diagonal braces 4; and a gasbag 5. The upper longitudinal plate 1 comprises a flat plate 1*a* adapting to support measuring instrument, and a flanged plate 1*b*. The lower longitudinal plate 2 is a rectangular plate, and is connected to the upper longitudinal plate 1 via the plurality of symmetrically disposed diaphragm plates 3. The diagonal braces 4 and longitudinal stiffeners 2*a* are disposed between every two adjacent diaphragm plates 3, thus increasing the longitudinal bending strength. Two diaphragm plates respectively disposed at two ends of the flat plate are provided with a lifting lug 7 for hanging the submarine survey platform. The gasbag 5 is disposed in and passes through each of the trapezoid openings 3*b*. One end of the gasbag 5 is connected to the gas tube 6; the other end of the gas tube 6 is provided with an air valve 6*a*, and the air valve 6*a* is attached to the floater 9, so that the gasbag can be inflated through the operation on the water surface, achieving the implementation of ascending the submarine survey platform.

Figure 4:
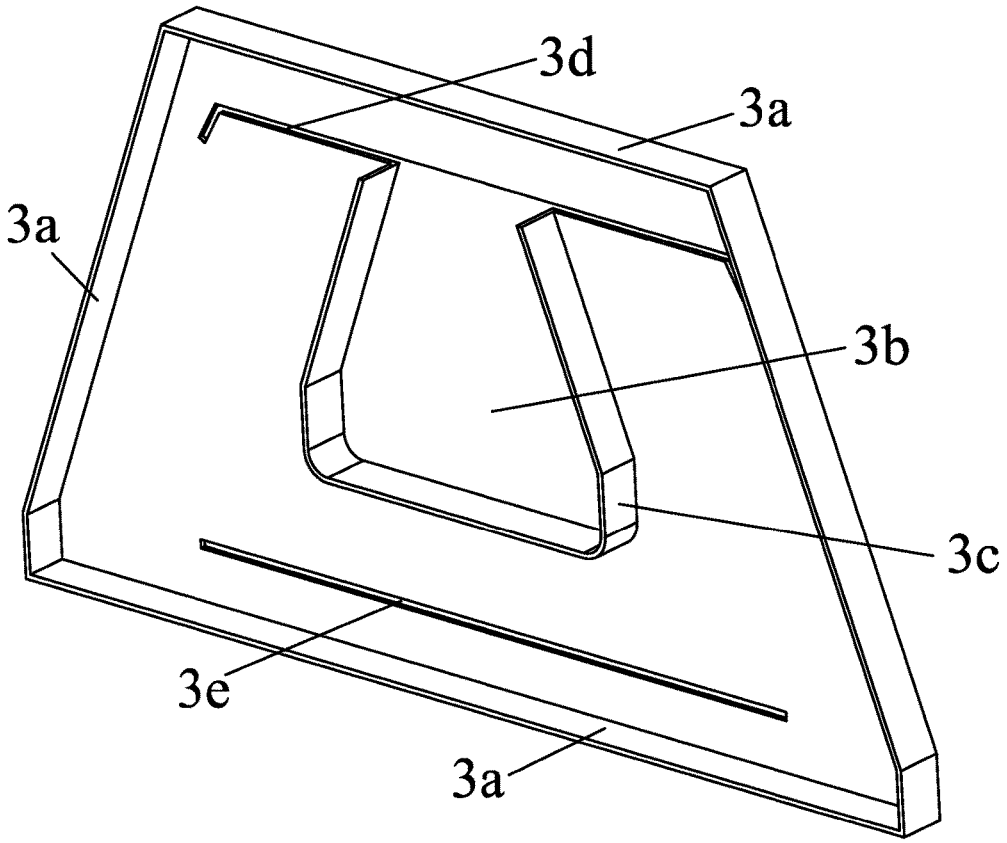
FIG. 4 is a schematic diagram of a diaphragm plate according to one embodiment of the disclosure.

FIG. 4 shows the structure of the diaphragm plates 3. The diaphragm plates comprise upper openings 3*d*, lower openings 3*e*, and trapezoid openings 3*b* disposed between the upper openings and the lower openings. The upper longitudinal plate pass through the upper openings, and the lower longitudinal plate pass through the lower openings. The design ensures the continuity of the longitudinal plates. Four edges of the diaphragm plates 3 comprise first flanged plates 3*a*, and the trapezoid openings 3*b* are surrounded by second flanged plates 3*c*; the folding directions are the same, thus increasing the stability of the submarine survey platform and the strength of the diaphragm plates 3.

Figure 5:
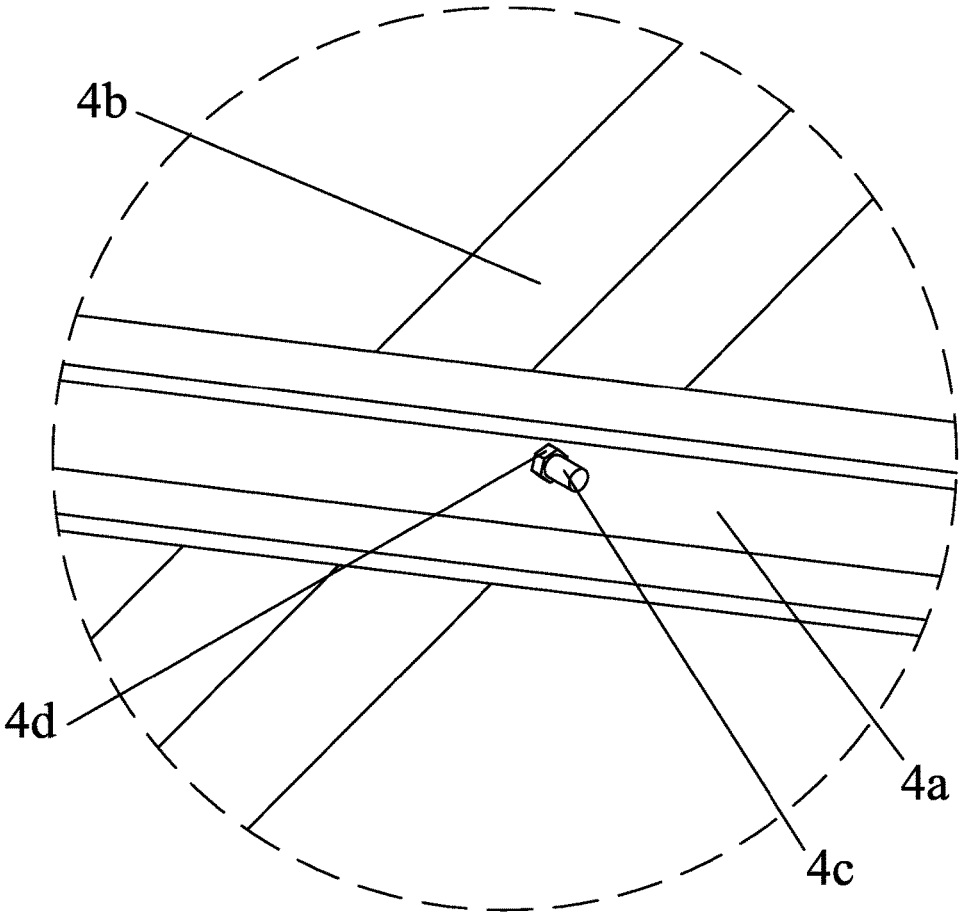
FIG. 5 is a local enlarged view of part A in FIG. 1.
Figure 6:
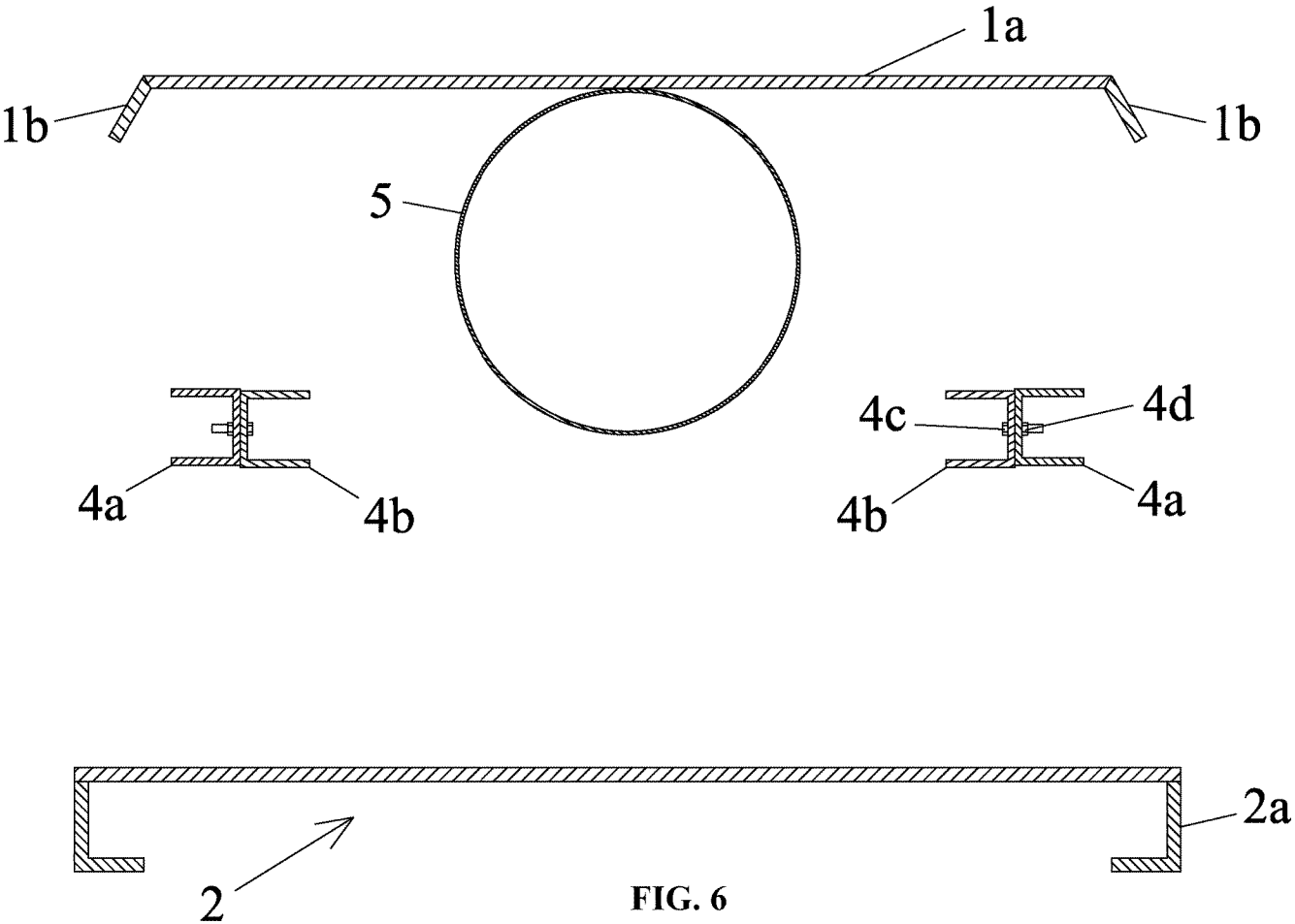
FIG. 6 is a cross-sectional view taken from line B-B in FIG. 2.
Figure 7:
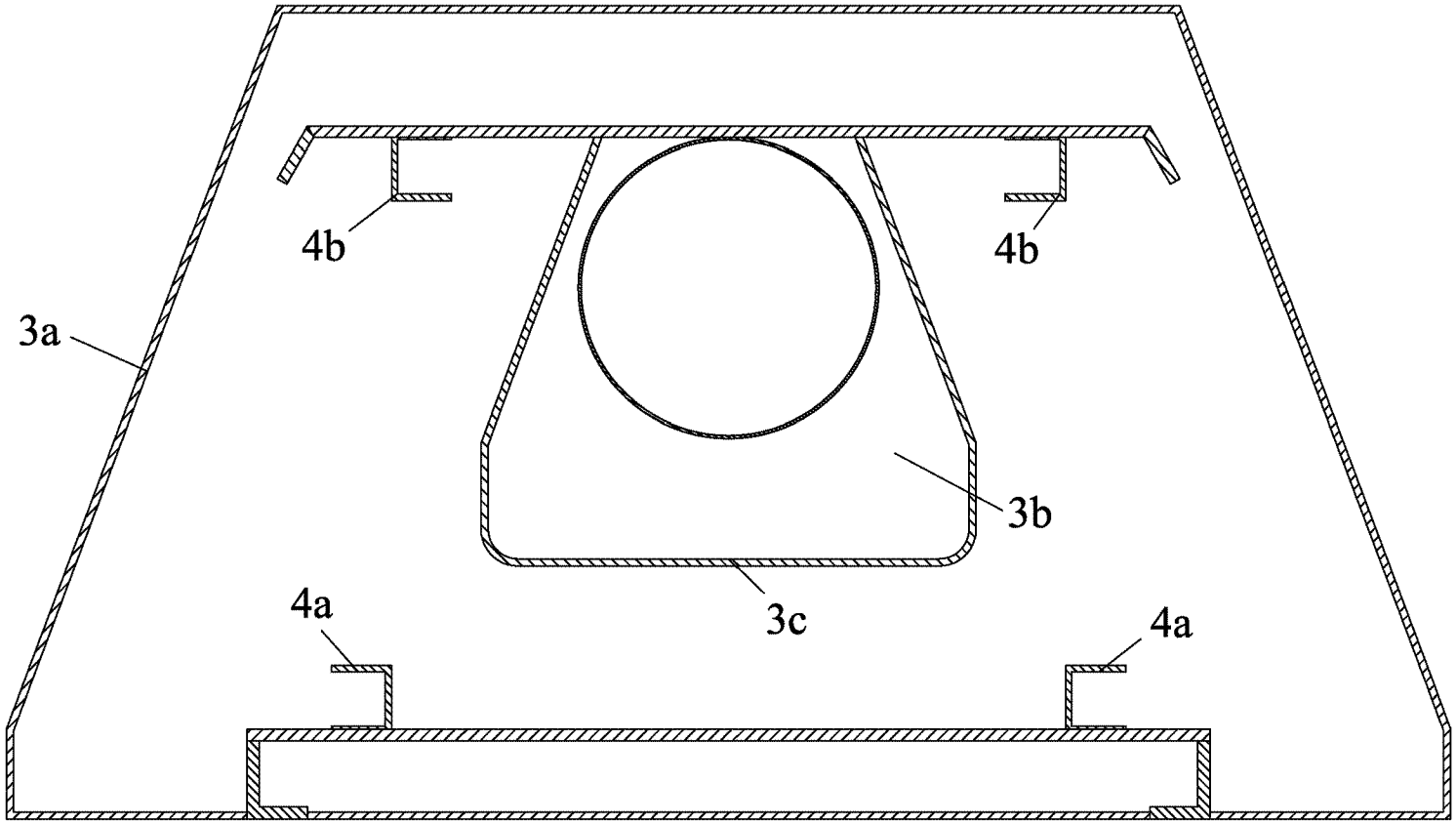
FIG. 7 is a cross-sectional view taken from line C-C in FIG. 2.

FIGS. 5, 6, and 7 show the structure of the diagonal braces 4 and longitudinal stiffeners 2*a*. The diagonal braces 4 employ trough type members and comprise outward braces 4*a* and inward braces 4*b* which are symmetrically disposed and crossed with each other; cross points of the outward braces 4*a* and the inward braces 4*b* are reinforced using bolt 4*c* and nuts 4*d*. The cross points of the upper/lower longitudinal plate with the diaphragm plates are support points of the upper/lower longitudinal plate. The structure and layout are beneficial to strengthening the local strength and reducing the deformation of the components. The longitudinal stiffeners 2*a* are symmetrically disposed at the bottom of the lower longitudinal plate 2, and are a right-angle structure connected to the lower longitudinal plate 2 and the diaphragm plates 3, thus reinforcing the entire structure of the submarine survey platform.

Figure 8:
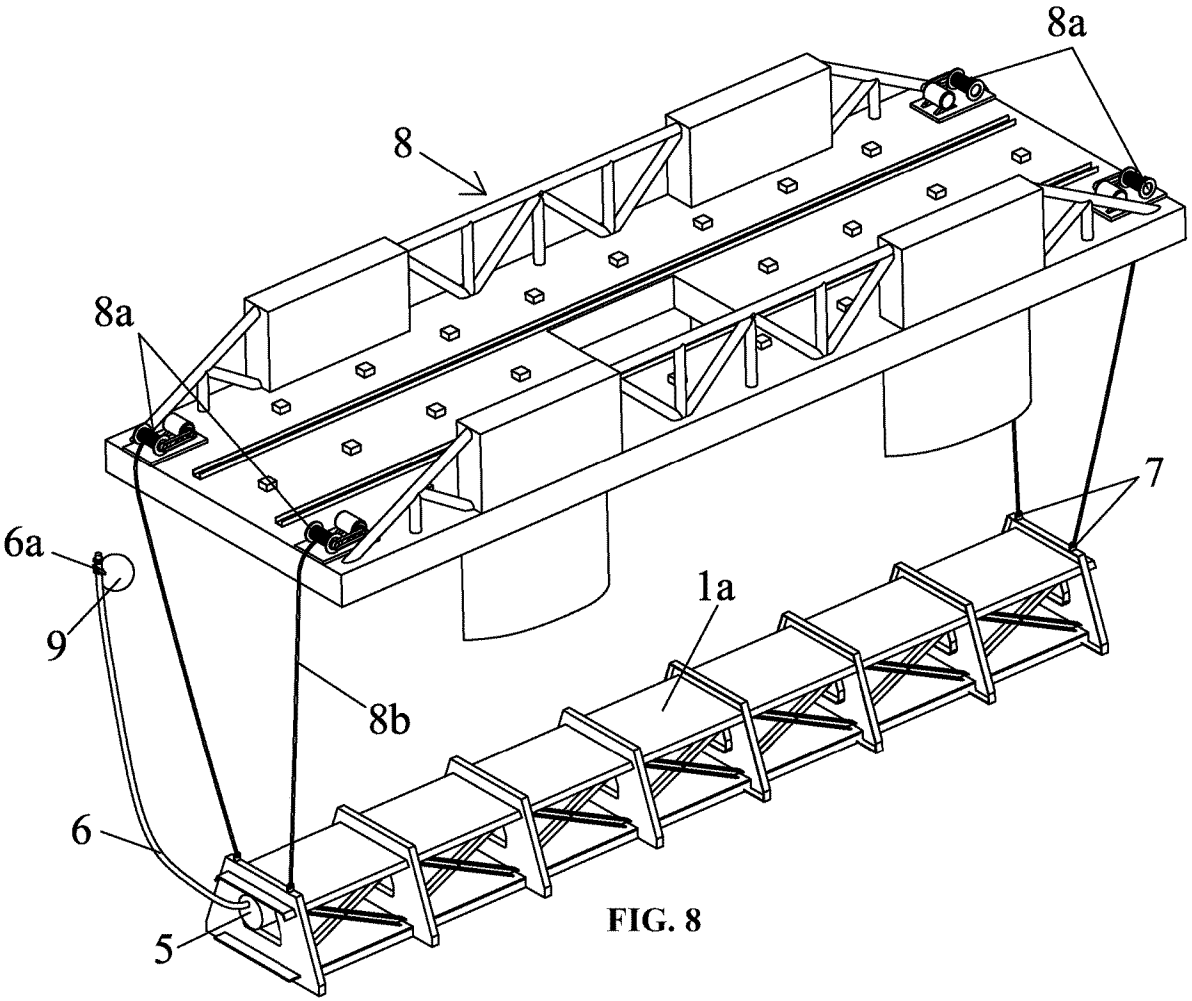
FIG. 8 shows a layout diagram of a submarine survey platform according to one embodiment of the disclosure.

FIGS. 8-9 show a layout diagram of the submarine survey platform of the disclosure. A floating transport platform 8 is employed to cooperate with the submarine survey platform to ensure the safety of the submarine survey platform in use. The floating transport platform 8 comprises a main deck, four winches are disposed on the main deck. The winches 8*a* are connected to the lifting lug 7 disposed at two ends of the flat plate of the submarine survey platform using the cable 8*b*. When the air valve 6*a* is in an open state, the winches 8*a* can control the submarine survey platform to sink gradually. The sink process is controlled by the winches, which is safe, reliable, convenient and efficient, can prevent the violent impact on the seabed due to the free sinking of the measuring platform.

FIG. 10 a flow chart for laying the submarine survey platform according to one embodiment of the disclosure. The method for using the submarine survey platform comprises:

(a) descending the submarine survey platform, which comprises:

providing a floating transport platform 8 equipped with a winch 8*a* and a cable 8*b;* installing the measuring instrument on the flat plate la;

inflating the gasbag 5 via the gas tube 6;

charging the floating transport platform 8 with water to descend the floating transport platform 8 to support the submarine survey platform;

allowing the flat plate la to float on water surface, and employing an assistant tug to drag the submarine survey platform away from a deck of the floating transport platform 8;

allowing the floating transport platform 8 to float upward, connecting the winch 8*a* and the lifting lug 7 of the submarine survey platform using the cable 8*b;* opening the air valve 6*a*, allowing the submarine survey platform to descend and tension the cable 8*b;* controlling, by the winch 8*a*, the submarine survey platform to sink and sit on seabed; and loosening the cable 8*b*, closing the air valve 6*a*, and attaching the gas tube 6 to the floater 9;

(b) withdrawing the submarine survey platform, which comprises:

picking up the gas tube 6 attached to the floater 9;

inflating the gasbag 5, and shutting down the air valve 6*a;* allowing the submarine survey platform to float on the water surface, descending the floating transport platform 8, employing the assistant tug to drag the submarine survey platform to the deck of the floating transport platform 8, and allowing the floating transport platform 8 to floating upward, achieving the recovery of the submarine survey platform.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A submarine survey platform, comprising:

a gasbag;

a gas tube;

a floater;

an upper longitudinal plate;

a lower longitudinal plate;

diaphragm plates, the diaphragm plates comprising upper openings, lower openings, and trapezoid openings disposed between the upper openings and the lower openings; and diagonal braces;

wherein the upper longitudinal plate comprises a flat plate adapting to support measuring instrument, and a flanged plate;

the lower longitudinal plate is a rectangular plate;

the upper longitudinal plate pass through the upper openings, and the lower longitudinal plate pass through the lower openings;

the diagonal braces and longitudinal stiffeners are disposed between every two adjacent diaphragm plates;

two diaphragm plates respectively disposed at two ends of the flat plate are provided with a lifting lug;

the diagonal braces are symmetrically disposed, and comprise outward braces and inward braces which are crossed with each other; cross points of the upper/lower longitudinal plate with the diaphragm plates are support points of the upper/lower longitudinal plate;

the gasbag is disposed in and passes through each of the trapezoid openings;

one end of the gasbag is connected to the gas tube; another end of the gas tube is provided with an air valve, and the air valve is attached to the floater;

the diaphragm plates are a trapezoidal frame, four edges of the diaphragm plates comprise first flanged plates, and the trapezoid openings are surrounded by second flanged plates;

the diagonal braces employ trough type members, cross points of the outward braces and the inward braces are reinforced using bolt and nuts; and the longitudinal stiffeners are symmetrically disposed at a bottom of the lower longitudinal plate, and are a right-angle structure connected to the lower longitudinal plate and the diaphragm plates.

2. A method for using the submarine survey platform of claim 1, the method comprising:

1) descending the submarine survey platform, which comprises:

providing a floating transport platform equipped with a winch and a cable;

installing the measuring instrument on the flat plate;

inflating the gasbag via the gas tube;

charging the floating transport platform with water to descend the floating transport platform to support the submarine survey platform;

allowing the flat plate to float on water surface, and employing an assistant tug to drag the submarine survey platform away from a deck of the floating transport platform;

allowing the floating transport platform to float upward, connecting the winch and the lifting lug of the submarine survey platform using the cable;

opening the air valve, allowing the submarine survey platform to descend and tension the cable;

controlling, by the winch, the submarine survey platform to sink and sit on seabed; and loosening the cable, closing the air valve, and attaching the gas tube to the floater;

2) withdrawing the submarine survey platform, which comprises:

picking up the gas tube attached to the floater;

inflating the gasbag, and shutting down the air valve; and allowing the submarine survey platform to float on the water surface, descending the floating transport platform, employing the assistant tug to drag the submarine survey platform to the deck of the floating transport platform, and allowing the floating transport platform to floating upward, achieving the withdrawal of the submarine survey platform.

* * * * *